US005211403A

United States Patent [19]

Ostrander

[11] Patent Number: 5,211,403

[45] Date of Patent: May 18, 1993

[54] GAME PLAYING PIECE

[76] Inventor: Edgar A. Ostrander, 164 Noel Dr., Centereach, N.Y. 11720

[21] Appl. No.: 853,575

[22] Filed: Mar. 18, 1992

[51] Int. Cl.[5] ..... A63F 3/00; G09F 3/02

[52] U.S. Cl. ..... 273/290; 273/288; 40/27.5

[58] Field of Search ..... 273/288-291; 40/27.5

[56] References Cited

U.S. PATENT DOCUMENTS 262,080 8/1882 McLeary ..... 40/27.5

1,472,657 10/1923 Lillard ..... 273/290

2,946,592 7/1960 Post ..... 273/290

FOREIGN PATENT DOCUMENTS 9937 of 1883 United Kingdom ..... 273/290

*Primary Examiner*—Benjamin H. Layno

*Attorney, Agent, or Firm*—Michael I. Kroll

[57] ABSTRACT

A game playing piece is provided which consists of a housing having two playing surfaces and a mechanism for indicating a value on the first playing surface of the housing.

1 Claim, 1 Drawing Sheet

GAME PLAYING PIECE

BACKGROUND OF THE INVENTION

1. Field of the Invention The instant invention relates generally to token chips and more specifically it relates to a game playing piece.

3. Description of the Prior Art

Numerous token chips have been provided in prior art that are adapted to be assigned to a player for movement on a game board during the play of a table top game. While these units may be suitable for the particular purpose to which they address, they would not be as suitable for the purposes of the present invention as heretofore described.

SUMMARY OF THE INVENTION

A primary object of the present invention is to provide a game playing piece that will overcome the shortcomings of the prior art devices.

Another object is to provide a game playing piece which is a flat round disc having an indicia labeled insert in one side thereof to represent a value when playing a game.

An additional object is to provide a game playing piece in which the indicia labeled insert can be removed and replaced to change the value of the game playing piece when the need arises, such as during the playing of the game.

A further object is to provide a game playing piece that is simple and easy to use.

A still further object is to provide a game playing piece that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
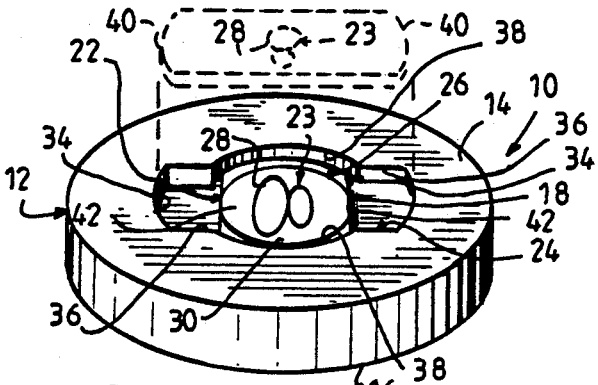
FIG. 1 is a top perspective view of the instant invention.
Figure 2:
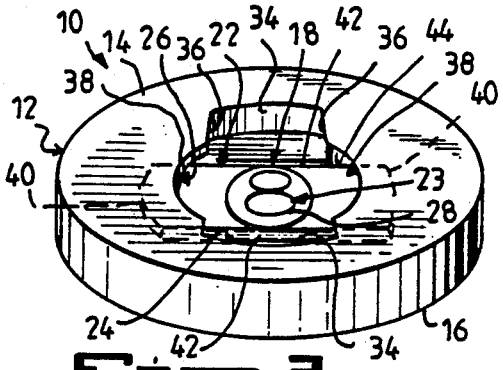
FIG. 2 is a top perspective view of the instant invention turned one hundred and eighty degrees to better see the indicia labeled insert therein.
Figure 3:
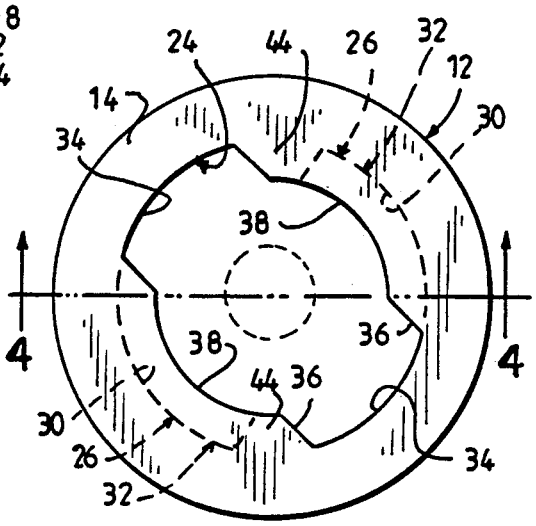
FIG. 3 is a top view with the indicia labeled insert removed.
Figure 4:
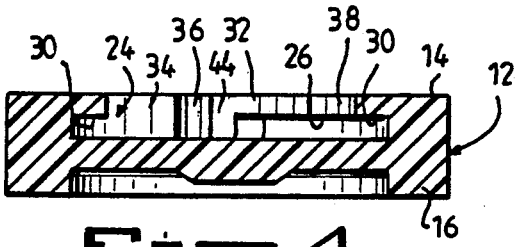
FIG. 4 is a cross sectional view taken along line 4—4 in FIG. 3.
Figure 2A:
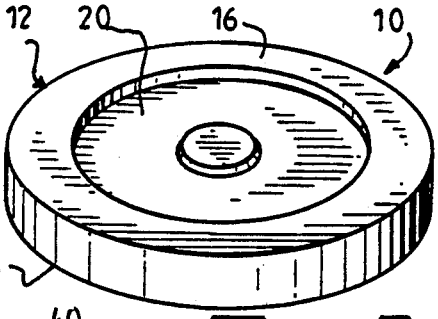
FIG. 2A is a bottom perspective view.

Turning now descriptively to the drawings, in which similar reference characters denote similar elements throughout the several views, the Figures illustrate a game playing piece 10, which consists of a housing 12 having two playing surfaces 14, 16 and a mechanism 18 for indicating a value on the first playing surface 14 of the housing 12.

The second playing surface 16 of the housing 12 is blank and can be turned upward during the play of a game to hide the value indicating mechanism 18 on the first playing surface 14 of the housing 12. The second playing surface 16 of the housing 12 has a donut shaped recess 20 therein to enhance the appearance of the second playing surface 16, when turned upward during the play of the game. The housing 12 of the game playing piece 10 is in a disc shaped configuration.

The value indicating mechanism 18 includes an indicia labeled insert 22 to represent a value 23. The first playing surface 14 of the housing 12 has a depression 24 therein. A mechanism 26 is for retaining the indicia labeled insert 22 within the depression 24 of the first playing surface 14 of the housing 12, so that the value 23 can be seen therefrom when the housing 12 is turned over to expose the first playing surface 14.

The indicia labeled insert 22 includes a numeral 28 printed thereon, which represents the value 23 of the game playing piece 10, when the housing 12 is turned over to expose the first playing surface 14.

The indicia labeled insert retaining mechanism 26 includes the depression 24 of the first playing surface 14 of the housing 12 having a pair of undercut slots 30 formed on opposite sides of the depression 24. When the indicia labeled insert 22 is inserted within the depression 24, the undercut slots 30 will retain the indicia labeled insert 22 therein.

The game playing piece 10 further includes a mechanism 32 for removably retaining the indicia labeled insert 22 within the depression 24 in the first playing surface 14 of the housing 12, so that a person playing the game can remove and replace the indicia labeled insert 22 to change the numerical value 28 of the game playing piece 10. The removable retaining mechanism 32 includes the depression 24 in the first playing surface 14 of the housing 12 being generally rectangular in which the short sides 34 are curved and the long sides 36 straight, with each having a curved cut back area 38. The undercut slots 30 are curved and oppositely positioned in the depression 24 at the long sides 36 behind the curved cut back area 38. The distance between the undercut slots 30 being approximately the same distance between the short sides 34 of the depression 24. The indicia labeled insert 22 is generally rectangular in which the short sides 40 are curved and the long sides 42 straight. The insert 22 is generally the same size as the depression 24, so that the indicia labeled insert 22 can be inserted into the depression 24 and when turned in one direction be retained by the curved undercut slots 30 and when turned in an opposite direction be released by the curved undercut slots 30.

The removable retaining mechanism 32 further includes a pair of stops 44, each formed between one end of one of the curved undercut slots 30 and one of the curved short ends 34 of the depression 24. When the indicia labeled insert 22 is turned in one direction to be retained by the curved undercut slots 30, the stops 44 on the opposite sides will position the indicia labeled insert 22 transversely across the depression 24. The indicia labeled insert 22 further includes a raised central boss 46 on the bottom surface 48, so that the raised central boss 46 will help in turning the indicia labeled insert 22 when placed within the depression 24.

Figure 5:
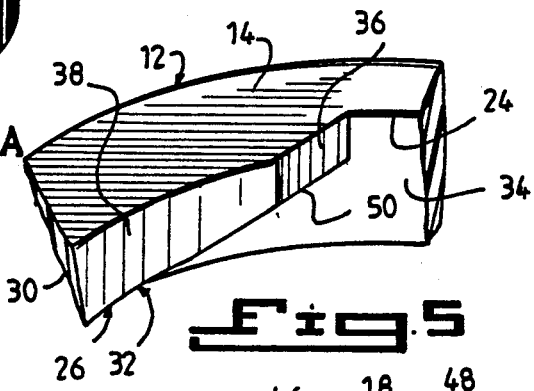
FIG. 5 is an enlarged perspective view of the overhang slot showing a cam leading edge therein.
Figure 6:
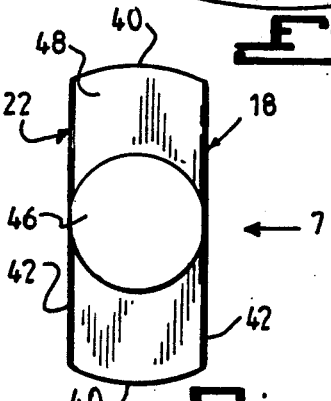
FIG. 6 is a bottom view of one typical indicia labeled insert.
Figure 7:
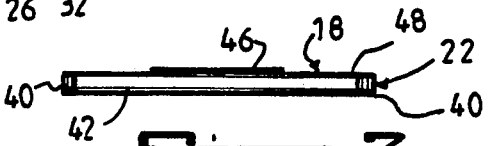
FIG. 7 is a side view of the insert as indicated by arrow 7 in FIG. 6.

As best shown in FIG. 5, each curved undercut slot 30 can further include a cam leading edge 50 opposite from the stop 44 to guide the indicia labeled insert 22 when the indicia labeled insert 22 is being turned in the depression 24 in the first playing surface 14 of the housing 12.

LIST OF REFERENCE NUMBERS 10 game playing piece 12 housing 14 first playing surface on 12 16 second playing surface on 12 18 value indicating mechanism 20 donut shaped recess in 16 22 indicia labeled insert 23 value 24 depression in 14 26 indicia labeled retaining mechanism 28 numeral for 23 30 undercut slot 32 removable retaining mechanism 34 short side of 24 36 long side of 24 38 curved cut back area at 36 40 short side of 22 42 long side of 22 44 stop in 32 46 raised central boss on 48 48 bottom surface of 22 50 cam leading edge on 30

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A game playing piece which comprises:

a) a housing having two playing surfaces, said housing is in a disc shaped configuration;

b) means for indicating a value on said first plaything surface of said housing, said second playing surface of said housing is blank and can be turned upward during the play of a game to hide said value indicating means on said first playing surface of said housing, said second playing surface of said housing has a donut shaped recess therein to enhance the appearance of said second playing surface when turned upward during the play of the game, said value indicating means includes an indicia labeled insert to represent a value, said first playing surface of said housing having a depression therein, means for retaining said indicia labeled insert within said depression of said first playing surface of said housing so that the value can be seen therefrom when said housing is turned over to expose said first playing surface, said indicia labeled insert includes a numeral printed thereon which represents the value of said game playing piece when said housing is turned over to expose said first playing surface, said indicia labeled insert retaining means includes said depression of said first playing surface of said housing having a pair of undercut slots formed on opposite sides of said depression so that when said indicia labeled insert is inserted within said depression said undercut slots will retain said indicia labeled insert therein, said indicia labeled insert further includes a raised central boss on the bottom surface so that said raised central boss will help in turning said indicia labeled insert when placed within said depression; and c) means for removably retaining said indicia labeled insert within said depression in said first playing surface of said housing so that a person playing the game can remove and replace said indicia labeled insert to change the numerical value of said game playing piece, said removable retaining means includes said depression in said first playing surface of said housing being generally rectangular in which the short sides are curved and the long sides straight with each having a curved cut back area, said undercut slots being curved and oppositely positioned in said depression at said long sides behind said curved cut back areas the distance between said undercut slots being approximately the same distance between said short sides of said depression, said indicia labeled insert being generally rectangular in which the short sides are curved and the long sides straight, said insert being generally the same size as said depression so that said indicia labeled insert can be inserted into said depression and when turned in one direction be retained by said curved undercut slots and when turned in an opposite direction be released by said curved undercut slots, said removable retaining means further includes a pair of stops, each formed between one end of one of said curved undercut slots and one of said curved short ends of said depression so that when said indicia labeled insert is turned in one direction to be retained by said curved undercut slots said stops on the opposite sides will position said indicia labeled insert transversely across said depression, each said curved undercut slot further includes a cam leading edge opposite from said stop to guide said indicia labeled insert when said indicia labeled insert is being turned in said depression in said first playing surface of said housing.

* * * * *